US006629579B1

(12) United States Patent
Hasegawa

(10) Patent No.: US 6,629,579 B1
(45) Date of Patent: Oct. 7, 2003

(54) HEADPHONES/EARMUFFS

(75) Inventor: Hiroshi Hasegawa, Kowloon (HK)

(73) Assignee: TWD-Acoustic Products Ltd., Kowloon (HK)

( * ) Notice: Subject to any disclaimer, the term of this patent is extended or adjusted under 35 U.S.C. 154(b) by 0 days.

(21) Appl. No.: 10/263,086

(22) Filed: Oct. 3, 2002

(51) Int. Cl.[7] ..... H04R 25/00; H04R 5/033; A42B 1/06

(52) U.S. Cl. ..... 181/129; 381/309; 2/208; 2/209

(58) Field of Search ..... 181/129, 128; 381/309; 2/208, 209

(56) References Cited

U.S. PATENT DOCUMENTS 2,782,423 A * 2/1957 Simon et al. ..... 2/209
2,990,553 A * 7/1961 Ulrich et al. ..... 2/209
3,220,505 A * 11/1965 Hargrave ..... 181/129
4,170,275 A * 10/1979 Larsen ..... 181/129
4,455,457 A * 6/1984 Akira ..... 181/141
4,546,215 A * 10/1985 Ferraro ..... 381/374
4,571,746 A * 2/1986 Gorike ..... 2/209
4,588,868 A * 5/1986 Bertagna et al. ..... 381/382
4,669,129 A * 6/1987 Chance ..... 2/209
4,965,836 A * 10/1990 Andre et al. ..... 381/370
5,018,599 A * 5/1991 Dohi et al. ..... 181/129
5,068,923 A * 12/1991 Sjoqvist ..... 2/209
5,293,647 A * 3/1994 Mirmilshteyn et al. ..... 2/209
5,406,037 A * 4/1995 Nageno et al. ..... 181/129
5,519,783 A * 5/1996 Kumar ..... 381/370
6,148,446 A * 11/2000 Leight ..... 2/209
6,353,938 B1 * 3/2002 Young ..... 2/209

* cited by examiner

*Primary Examiner*—Robert E. Nappi
*Assistant Examiner*—Eduardo Colon-Santana
(74) *Attorney, Agent, or Firm*—Leydig, Voit & Mayer, Ltd.

(57) ABSTRACT

A headphone/earmuff includes a headband, a pair of ear cups and associated positioning devices attaching each ear cup to the headband. Each ear cup positioning device has a cylinder attached to either the ear cup or the headband, and a piston received slidably within the cylinder and attached to the other of the headband or the ear cup.

3 Claims, 2 Drawing Sheets

HEADPHONES/EARMUFFS

BACKGROUND OF THE INVENTION

The present invention relates to headphones, headsets and earmuffs. More particularly, although not exclusively, the invention relates to a headphone/earmuffs having a headband extending between a pair of ear cups, wherein at least one of the ear cups is adjustable with respect to the headband by means of a piston-in-cylinder arrangement.

Headphones such as hi-fi stereo headphones have a pair of ear cups attached at respective ends of a headband that extends over the head of the wearer. Earmuffs for protecting the ears from outside noise are of similar overall structure. Headphones and earmuffs having repositionable ear cups are well known. In such headphones/earmuffs, at least one of the ear cups can slide up and down. Some headphones have a metallic strip functioning as a headband, wherein the metallic strip has an end portion that slides within a part associated with the ear cup. Some headphones/earmuffs have a click-positioning device to retain the position of the ear cups with respect to the headband.

The type of positioning systems described above usually have a cheap feel, are prone to positional overshooting and/or slippage during/after adjustment and leave room for general improvement.

OBKECTS OF THE INVENTION

It is an object of the present invention to overcome or substantially ameliorate at least one of the above disadvantages and/or more generally to provide an improved headphone/earmuff.

It is a further object of the present invention to provide an improved ear cup positioning device for a headphone or earmuff.

DISCLOSURE OF THE INVENTION

There is disclosed herein a headphone/earmuff comprising:

a headband, an ear cup, an ear cup positioning device attaching the ear cup to the headband, the ear cup positioning device comprising a cylinder attached to either the ear cup or the headband, and a piston received slidably within the cylinder and attached to the other of the headband or the ear cup.

Preferably the piston has an annular groove within which an O-ring is received, the O-ring bearing against an inner surface of the cylinder.

Preferably the ear cup positioning device is attached pivotally to the headband.

Preferably the cylinder is attached to the headband by a hinge.

Preferably the cylinder is received within a housing that is attached to the headband.

Preferably the piston includes a leg extending to the ear cup.

Preferably a speaker is located within the ear cup.

Preferably a wire extending from the speaker passes through the leg and into the cylinder and exits the housing via the hinge.

Preferably the headphone/earmuff includes two ear cups.

Preferably each ear cup includes a speaker.

Preferably the wire extends along the headband from one ear cup to the other.

Preferably the wire folds within the cylinder as the piston is moved therein.

Preferably there is an air chamber within the cylinder, the volume of which varies upon movement of the piston therein.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
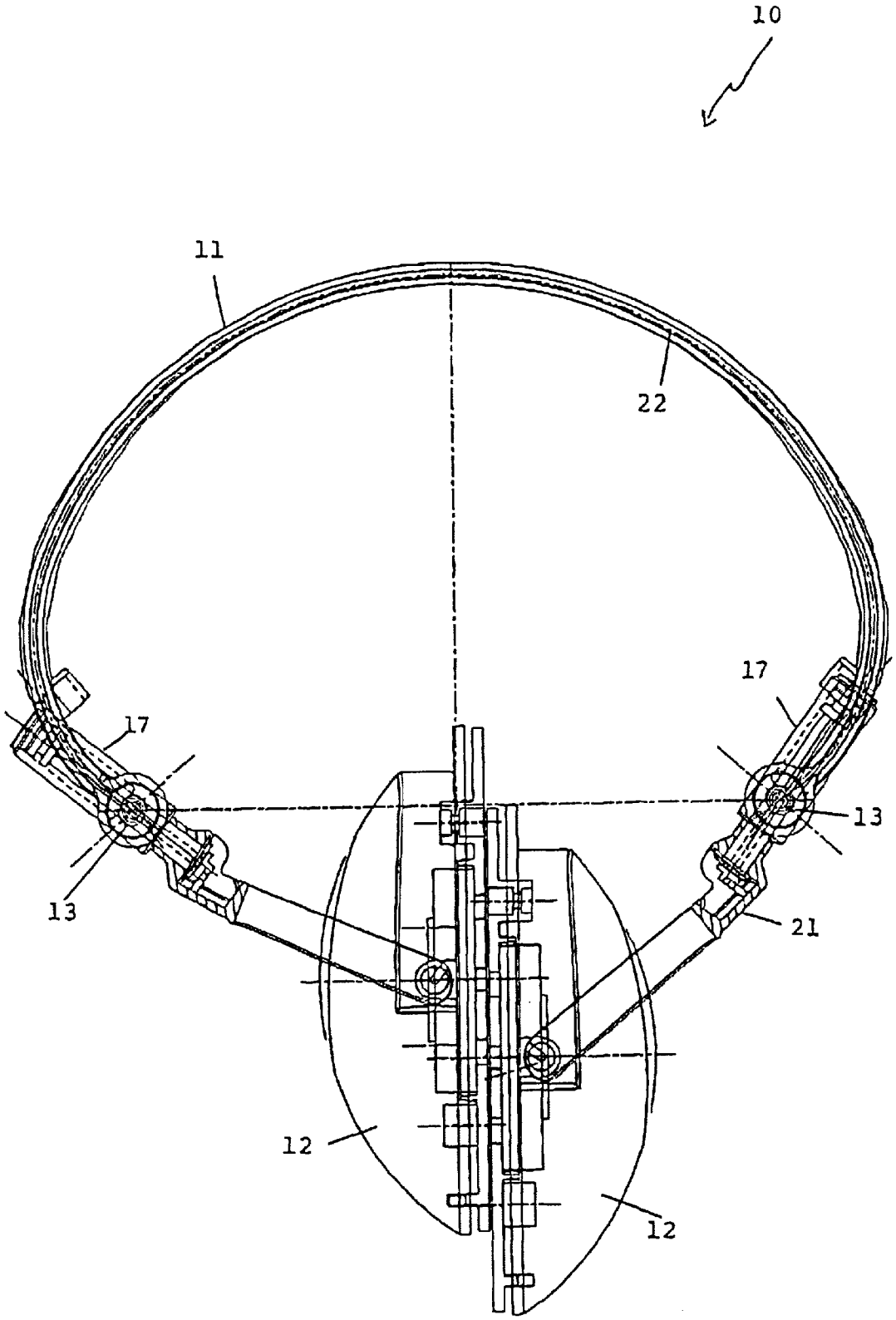
FIG. 1 is a schematic cross-sectional elevational view of a pair of headphones.

In the accompanying drawings there is schematically depicted a set of headphones 10. The headphones comprise a pair of ear cups 12, each pivotally attached to a leg 21. Each leg 21 is an extension of a piston 18 received slidably within a cylinder 17. The cylinder 17 is attached pivotally via a hinge 13 to a housing 16, which is attached to a headband 11.

The components described above are typically formed of moulded plastics material such as PVC, ABS PP or PC for example.

Figure 2:
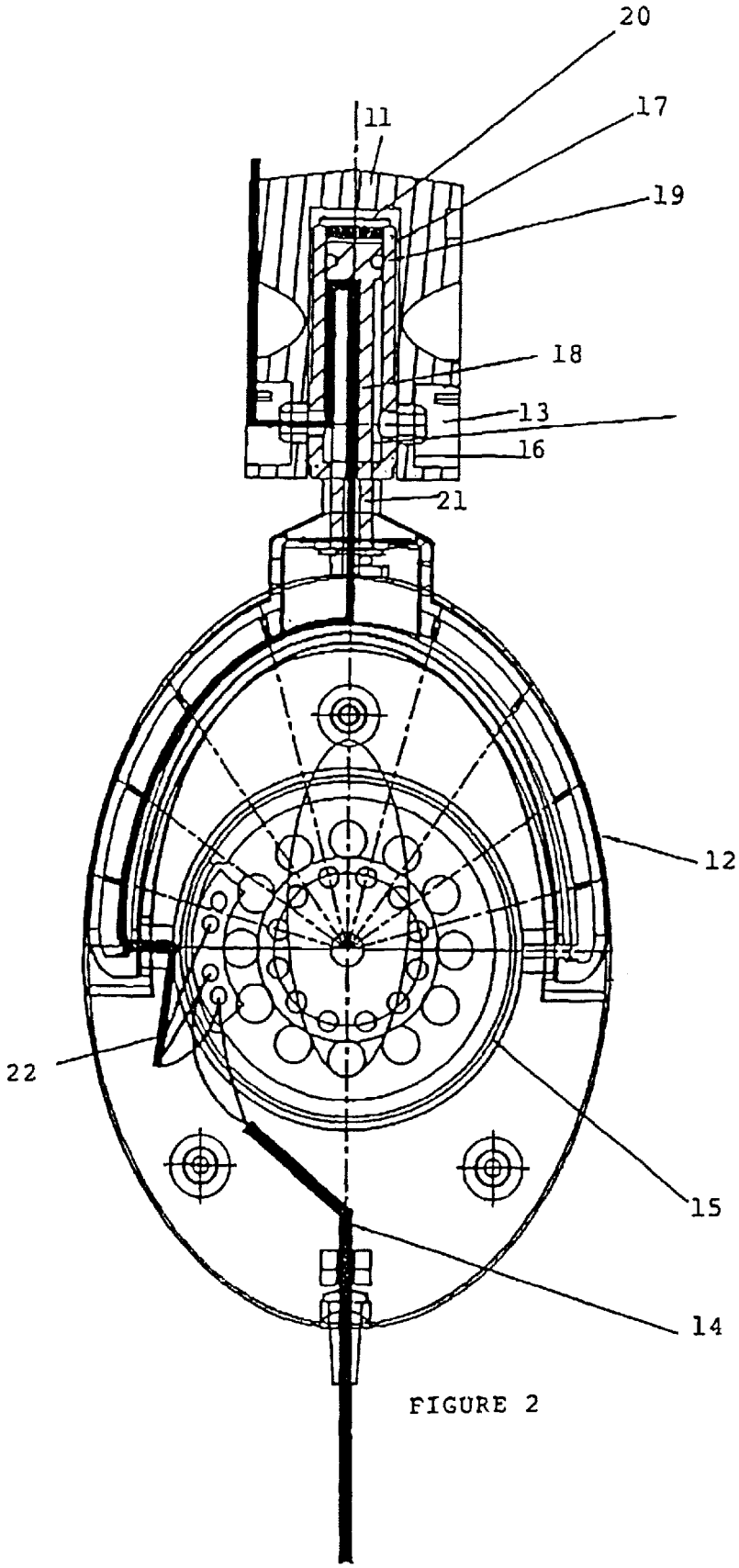
FIG. 2 is a schematic cross-sectional side elevational view of an ear cup and its associated positioning components.

Within each ear cup 12 there is a speaker 15. One of the ear cups has a wire 14 extending therefrom and via which electric sound signals are transmitted to the speakers. Another wire 22 extends from the speaker 15 shown in FIG. 2 through the headband to the speaker in the other ear cup.

The wire 22 passes through the leg 21 and via the piston 18 into the cylinder 17 whereupon it folds back upon itself prior to exiting through the hinge 13 en route to the headband 11 through which it passes.

There is a seal such as an O-ring 19 fitted within an annular groove of the piston 18 that substantially seals an air chamber 20 within the cylinder 17. This is not intended to be a perfect fluid-tight seal, but a barrier past which air within the air chamber 20 can escape slowly. It is intended however that the O-ring 19 fit fairly tightly within the cylinder 17 to maintain the position of the cylinder therein once adjusted by the user.

It should be appreciated that modifications and alterations obvious to those skilled in the art are not to be considered as beyond the scope of the present invention. For example, separate wires might lead externally to each ear cup instead of passing a wire through the piston, cylinder and headband from one cup to the other. Also, the piston might be attached to the headband instead of the ear cup, in which case the cylinder would be attached to the ear cup. Furthermore, the ear cup adjusting mechanism can be used on earmuffs in which each ear cup has no speaker. For example, modern earmuffs having internal sound-deadening baffles can benefit from the disclosed year cup adjusting mechanism. Tradesmen, factory workers, street workers and other people exposed to high-decibel noise, might use such earmuffs. Also, the invention is applicable to mono headsets that have only one ear cup such as are used with computers and telephones.

What is claimed is:

1. A headphone/earmuff comprising:

a headband, two ear cups, a speaker within each ear cup, an ear cup positioning device attaching one of the ear cups to the headband, the ear cup positioning device comprising a cylinder including a piston received slidably within the cylinder, the piston extending to form a leg attached to the ear cup, the cylinder being attached via a hinge to a housing, wherein the housing is attached to the headband, a wire extending along the headband from one speaker within one ear cup to the other speaker within the other ear cup, the other ear cup including the leg attached thereto, wherein the wire extends through the leg and into the cylinder of the ear cup positioning device to exit the housing via the hinge, and the wire folds within the cylinder as the piston is moved in the cylinder.

2. The headphone/earmuff of claim 1 wherein there is an air chamber within the cylinder, the volume of which varies upon movement of the piston therein.

3. The headphone/earmuff of claim 1, including an additional ear cup positioning device attaching the other ear cup to the headband.

* * * * *